US009469902B2

(12) United States Patent
Norkus et al.

(10) Patent No.: US 9,469,902 B2
(45) Date of Patent: Oct. 18, 2016

(54) ELECTROLESS DEPOSITION OF CONTINUOUS PLATINUM LAYER

(71) Applicant: Lam Research Corporation, Fremont, CA (US)

(72) Inventors: Eugenijus Norkus, Vilnius (LT); Aldona Jagminiene, Vilnius (LT); Albina Zieliene, Vilnius (LT); Ina Stankeviciene, Vilnius (LT); Loreta Tamasauskaite-Tamasiunaite, Vilnius (LT); Aniruddha Joi, Fremont, CA (US); Yezdi Dordi, Palo Alto, CA (US)

(73) Assignee: Lam Research Corporation, Fremont, CA (US)

( * ) Notice: Subject to any disclaimer, the term of this patent is extended or adjusted under 35 U.S.C. 154(b) by 299 days.

(21) Appl. No.: 14/182,987

(22) Filed: Feb. 18, 2014

(65) Prior Publication Data

US 2015/0232995 A1 Aug. 20, 2015

(51) Int. Cl.
*C23C 18/44* (2006.01)
*C23C 18/16* (2006.01)

(52) U.S. Cl.
CPC ..... *C23C 18/44* (2013.01); *C23C 18/1675* (2013.01); *C23C 18/1617* (2013.01)

(58) Field of Classification Search
CPC . C23C 18/44; C23C 18/1617; C23C 18/166; C23C 18/168; C23C 18/1683
USPC ..... 106/1.24, 1.28; 427/443.1
See application file for complete search history.

(56) References Cited

U.S. PATENT DOCUMENTS

| | | | | | |
|---|---|---|---|---|---|
| 3,698,939 | A * | 10/1972 | Leaman | C23C 18/44 | 106/1.28 |
| 4,004,051 | A * | 1/1977 | Kadison | C23C 18/28 | 106/1.11 |
| 4,279,951 | A * | 7/1981 | Hough | C23C 18/44 | 106/1.24 |
| 5,160,373 | A | 11/1992 | Senda et al. | | |
| 5,360,471 | A * | 11/1994 | Takano | C23C 18/48 | 106/1.22 |
| 5,364,459 | A | 11/1994 | Senda et al. | | |
| 6,338,787 | B1 | 1/2002 | Obata et al. | | |
| 8,801,844 | B2 * | 8/2014 | Kilian | C23C 18/31 | 106/1.22 |
| 2002/0152955 | A1 * | 10/2002 | Dordi | C23C 18/1683 | 118/63 |
| 2004/0037770 | A1 * | 2/2004 | Fischer | C23C 18/285 | 423/584 |
| 2005/0106382 | A1 * | 5/2005 | Kashihara | H01R 43/007 | 428/330 |
| 2012/0104331 | A1 * | 5/2012 | Kolics | C23C 18/48 | 106/1.28 |
| 2015/0284857 | A1 * | 10/2015 | Norkus | C23C 18/44 | 106/1.24 |
| 2015/0307993 | A1 * | 10/2015 | Norkus | C23C 18/31 | 438/678 |
| 2015/0307994 | A1 * | 10/2015 | Norkus | C23C 18/34 | 427/443.1 |
| 2015/0307995 | A1 * | 10/2015 | Norkus | C23C 18/52 | 438/678 |

* cited by examiner

*Primary Examiner* — Helene Klemanski
(74) *Attorney, Agent, or Firm* — Beyer Law Group LLP

(57) ABSTRACT

A method for providing an electroless plating of a platinum containing layer is provided. A $Ti^{3+}$ stabilization solution is provided. A $Pt^{4+}$ stabilization solution is provided. A flow from the $Ti^{3+}$ stabilization solution is combined with a flow from the $Pt^{4+}$ stabilization solution and water to provide a diluted mixture of the $Ti^{3+}$ stabilization solution and the $Pt^{4+}$ stabilization solution. A substrate is exposed to the diluted mixture of the $Ti^{3+}$ stabilization solution and the $Pt^{4+}$ stabilization solution.

26 Claims, 2 Drawing Sheets

ELECTROLESS DEPOSITION OF CONTINUOUS PLATINUM LAYER

BACKGROUND OF THE INVENTION

Field of the Invention

The invention relates to a method of forming semiconductor devices on a semiconductor wafer. More specifically, the invention relates to depositing platinum containing layers to form semiconductor devices.

In forming semiconductor devices, thin layers of platinum may be deposited. Such a deposition may be provided by electroplating.

SUMMARY OF THE INVENTION

To achieve the foregoing and in accordance with the purpose of the present invention, a method for providing an electroless plating of a platinum containing layer is provided. A $Ti^{3+}$ stabilization solution is provided. A $Pt^{4+}$ stabilization solution is provided. A flow from the $Ti^{3+}$ stabilization solution is combined with a flow from the $Pt^{4+}$ stabilization solution and water to provide a diluted mixture of the $Ti^{3+}$ stabilization solution and the $Pt^{4+}$ stabilization solution. A substrate is exposed to the diluted mixture of the $Ti^{3+}$ stabilization solution and the $Pt^{4+}$ stabilization solution.

In another manifestation of the invention, a solution for electroless deposition of platinum is provided. The solution comprises $Ti^{3+}$ ions, $Pt^{4+}$ ions, $NH_4^+$ ions, citrate, and gluconate or tartarate ions. A ratio of $Ti^{3+}$ to $Pt^{4+}$ ion is between 100:1 to 2:1.

In another manifestation of the invention, a method for providing an electroless plating of a platinum layer is provided. A solution for electroless deposition of platinum is provided. The solution comprises $Ti^{3+}$ ions, $Pt^{4+}$ ions, wherein a ratio of $Ti^{3+}$ to $Pt^{4+}$ ion is between 100:1 to 2:1, $NH_4^+$ ions, citrate and gluconate or tartarate ions. A substrate is exposed to the solution for electroless deposition of platinum.

These and other features of the present invention will be described in more details below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

Figure 1:
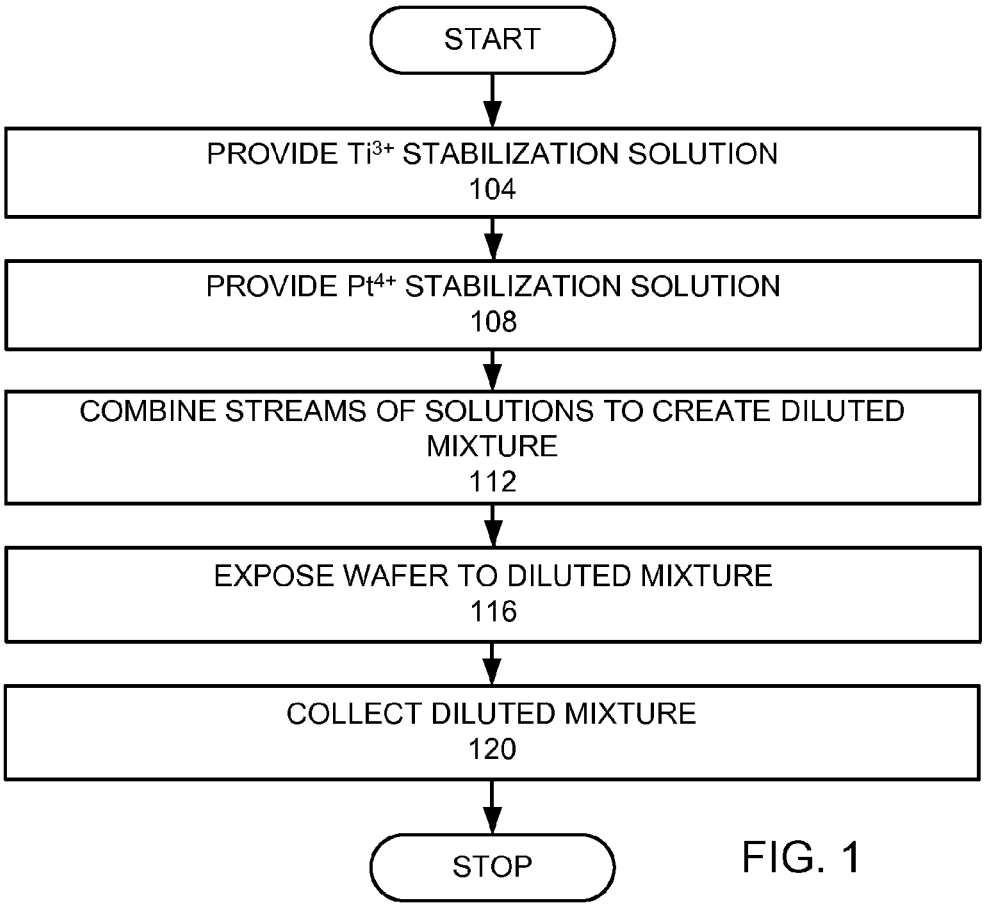
FIG. 1 is a flow chart of an embodiment of the invention.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Electroless deposition of platinum has been accomplished using hydrazine and other hydrogen containing compounds as reducing agents. In addition to the environmental concerns associated with these hydrogen containing reducing agents, the oxidation reaction of these species involves the generation of $N_2$ gas, which can be incorporated in the deposit. This impacts the purity of the deposited film, as well as quality of the coatings. Additionally, the hydrazine-platinum electrolyte requires operation at an elevated temperature and high pH for practical applications. Such requirements are undesirable for back end metallization of semiconductor interconnects, as the dielectric materials are prone to damage at high pH or temperature.

An embodiment of the invention provides an electroless plating bath containing $Ti^{3+}$ for depositing $Pt^{4+}$, where the $Pt^{4+}$ is reduced from solution, while $Ti^{3+}$ is oxidized to a higher more stable oxidation state of $Ti^{4+}$. $Ti^{3+}$ has significant benefits over hydrazine and other hydrogen containing reducing agents. Replacing hydrazine with $Ti^{3+}$ metal ion reducing agent eliminates the toxicity and volatility that is inherent to hydrazine and makes the plating bath more environmentally friendly. Additionally, no gas evolution (i.e. $N_2$) or side reaction is observed at the electrode. This results in a smooth, continuous, pure Pt film. The $Ti^{3+}$ metal ion containing plating bath can also be operated over a wide temperature and pH range. The ability to deposit pure platinum film selectively at room temperature and relatively low pH makes its application in back end interconnect metallization particularly attractive, since conventional electrolytes operate at high pH and temperature which causes pattern collapse.

The $Ti^{3+}$ metal ion reducing agent containing bath, used in an embodiment of the invention, is operable below room temperature and with a low pH. This is not possible with the hydrazine and other reducing agent containing electrolyte. The extended window of operation makes this bath attractive for application as a copper capping layer in interconnects metallization where low pH and low temperature are desired to prevent pattern collapse.

Formation of Pt electrodes for memory applications using plasma etching is difficult. An embodiment of the invention enables selective patterning of Pt electrodes in semiconductor manufacturing without using plasma etching. The cost and complexity associated with maintaining a high temperature during plating can also be reduced due to near room temperature operation of the $Ti^{3+}$ metal ion reducing agent electrolyte.

FIG. 1 is a high level flow chart of an embodiment of the invention. In this embodiment, a $Ti^{3+}$ stabilization solution is provided (step 104). A $Pt^{4+}$ stabilization solution is provided (step 108). A flow from the $Ti^{3+}$ stabilization solution is combined with a flow from the $Pt^{4+}$ stabilization solution and water to provide a diluted mixture of the $Ti^{3+}$ stabilization solution and the $Pt^{4+}$ stabilization solution (step 112). A wafer is exposed to the diluted mixture of the $Ti^{3+}$ stabilization solution and the $Pt^{4+}$ stabilization solution (step 116). The diluted mixture is collected and may be reactivated for future use or disposed (step 120).

Figure 2:
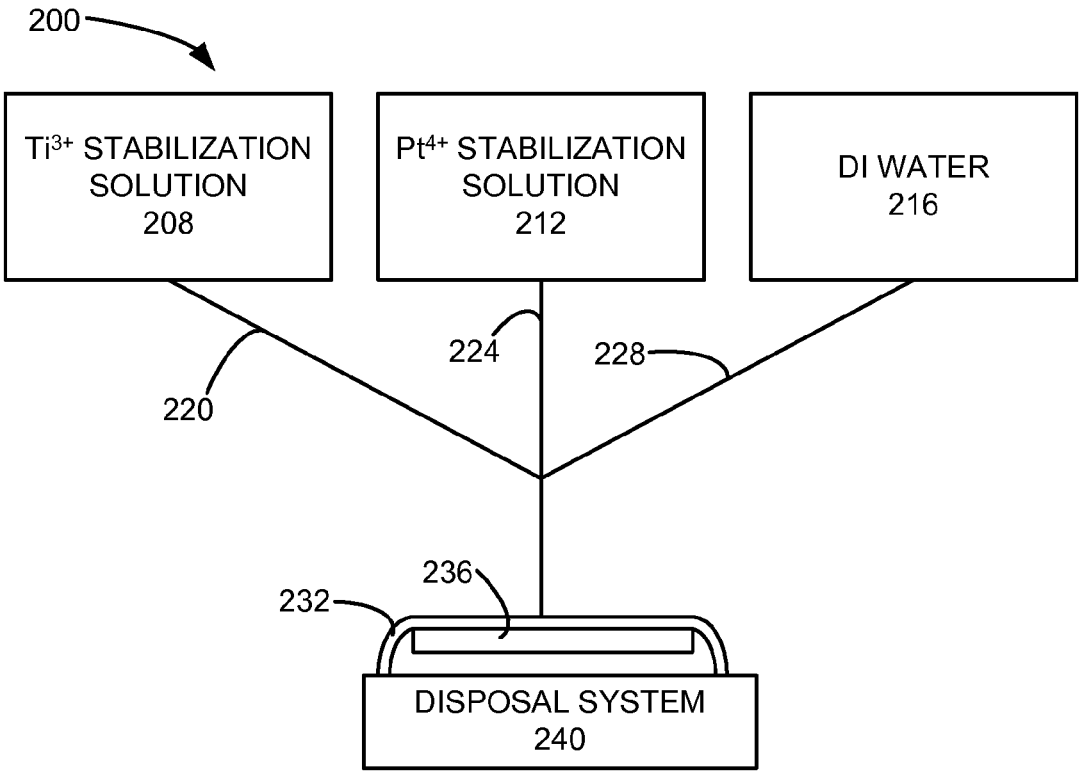
FIG. 2 is a schematic view of a system that may be used in an embodiment of the invention.

In an example, a $Ti^{3+}$ stabilization solution is provided in a $Ti^{3+}$ stabilization solution source (step 104). A $Pt^{4+}$ stabilization solution is provided in a $Pt^{4+}$ stabilization solution source (step 108). FIG. 2 is a schematic view of a system 200 that may be used in an embodiment of the invention. The system comprises a $Ti^{3+}$ stabilization solution source 208 containing a $Ti^{3+}$ stabilization solution, a $Pt^{4+}$ stabilization solution source 212 containing a $Pt^{4+}$ stabilization solution, and a deionized water (DI) source 216 containing DI. A flow 220 from the $Ti^{3+}$ stabilization solution source 208 is combined with a flow 224 from the $Pt^{4+}$ stabilization solution source 212 and a flow 228 from the DI water source 216 to provide a diluted mixture 232 of the $Ti^{3+}$ stabilization solution and the $Pt^{4+}$ stabilization solution (step 112). A wafer 236 is exposed to the diluted mixture 232 of the $Ti^{3+}$ stabilization solution and the $Pt^{4+}$ stabilization solution (step 116). The diluted mixture 232 is collected (step 120). A disposal system 240 may be used to dispose the diluted mixture 232. An alternative embodiment provides the collection of the diluted mixture 232, which is reactivated.

In this example, the $Ti^{3+}$ stabilization solution comprises a $TiCl_3$ solution in diluted hydrochloric acid with or without citric acid or trisodium citrate. The $Ti^{3+}$ stabilization solution may further comprise $NH_4OH$. The $Pt^{4+}$ stabilization solution comprises $H_2PtCl_6$, trisodium gluconate or gluconic acid, and ammonium hydroxide.

In one embodiment, the flow 220 of the $Ti^{3+}$ stabilization solution is combined with the flow 224 of the $Pt^{4+}$ stabilization solution and the flow 228 of DI water, to form a diluted mixture of 0.05M $TiCl_3$, 0.32M $NH_4OH$, 0.002M $H_2PtCl_6$, 0.15M $Na_3$Citrate, and 0.025M $Na_3$Gluconate. The diluted mixture has a pH of between 9-10 and a temperature of about 20° C.

The $Ti^{3+}$ stabilization solution provides a stable $Ti^{3+}$ solution that has a shelf life of several months without degrading. The high concentration allows the $Ti^{3+}$ stabilization solution to be stored in a smaller volume. In addition, the $Pt^{4+}$ stabilization solution provides a stable $Pt^{4+}$ solution that has a shelf life of several months without degrading. The high concentration allows the $Pt^{4+}$ stabilization solution to be stored in a smaller volume. The solutions are combined and diluted just prior to exposing the wafer to the diluted mixture, since the diluted mixture does not have as long a shelf life as the stabilization solutions.

This embodiment of the invention provides a platinum containing layer with a thickness of between 1 nm and 30 nm. Preferably, the platinum containing layer is pure platinum. Because the platinum containing layer is relatively thin, a dilute bath is sufficient. In one embodiment, the wafer is exposed to a continuous flow of the diluted mixture. In another embodiment, the wafer is placed in a still bath of the diluted mixture for a period of time. Since the concentration of platinum and titanium is very low in the diluted mixture, in one embodiment, the diluted mixture may be disposed (step 120) after being exposed to the wafer, since the low concentration means that only a small amount of platinum and titanium is discarded. In another embodiment, the diluted mixture is recycled after being exposed to the wafer. The recycling may be accomplished through reactivation of the dilute mixture.

Generally the solution mixture used for plating has $Ti^{3+}$ and $Pt^{4+}$ ions at a $Ti^{3+}$ to $Pt^{4+}$ ion ratio between 100:1 to 2:1. More preferably, the solution mixture used for plating has $Ti^{3+}$ and $Pt^{4+}$ ions at a $Ti^{3+}$ to $Pt^{4+}$ ion ratio between 50:1 to 4:1. In addition, the solution mixture has a ratio of citrate to $Ti^{3+}$ is between 30:1 to 2:1. More preferably, the solution mixture has a ratio of citrate to $Ti^{3+}$ is between 15:1 to 3:1. Preferably, the solution mixture has a ratio of $NH_4^+$ to $Ti^{3+}$ is between 12:1 to 3:1. In addition, the solution mixture has citrate from $Na_3$Citrate or citric acid and Gluconate from $Na_3$ Gluconate or Gluconic acid. In addition, the $Pt^{4+}$ ions come from $H_2PtCl_6$. The $Ti^{3+}$ ions come from $TiCl_3$. The $NH_4^+$ ions come from $NH_4OH$. Without being limited by theory, it is believed that ammonia ligands help to provide a lower temperature and lower pH platinum deposition.

Generally, a wafer or other plating surface is exposed to the solution mixture at a temperature between 10° to 40° C. A plating surface is a surface on which the platinum containing layer is selectively deposited. Such selective deposition may use a mask to protect surfaces where deposition is not desired. Preferably, the solution mixture has a pH from 6 to 10. Preferably, the solution mixture provides $Ti^{3+}$ with a concentration between 5-300 mM. More preferably, the solution mixture provides $Ti^{3+}$ with a concentration between 25-75 mM. Preferably, the solution mixture provides $Ti^{3+}$ with a concentration between 25-75 mM. Most preferably, the solution mixture provides $Ti^{3+}$ with a concentration between 30-60 mM. The lower temperature and lower pH provide a deposition with less damage to layers provided by the semiconductor fabrication process. In addition, such a process does not require any activation step that might attack and damage the copper substrate. In addition, such a process does not create a gas byproduct.

Preferably, the solution mixture is boron free. Preferably, the solution mixture is phosphorus free. Preferably, the solution mixture is hydrazine free. Preferably, the solution mixture is formaldehyde free. It has been found that providing a solution mixture that is boron, phosphorus, hydrazine, and formaldehyde free allows for a more pure plating that does not have impurities provided by using boron-containing reducing agents, phosphorus-containing reducing agents, hydrazine, or formaldehyde. In addition, avoiding using hydrazine, provides a safer and more environmentally friendlier process.

In other embodiments, the source of $Ti^{3+}$ is $Ti_2(SO_4)_3$ or other soluble salts of $Ti^{3+}$. Trisodium citrate or citric acid can be displaced by disodium salts of the isomers of tartaric acid. Trisodium gluconate or gluconic acid can be replaced with methoxyacetic acid or other carboxylic acid ligands.

In one embodiment, the deposited platinum containing layer is at least 99.9% pure platinum. More preferably, the deposited platinum containing layer is pure platinum.

While this invention has been described in terms of several preferred embodiments, there are alterations, permutations, and various substitute equivalents, which fall within the scope of this invention. It should also be noted that there are many alternative ways of implementing the methods and apparatuses of the present invention. It is therefore intended that the following appended claims be interpreted as including all such alterations, permutations, and various substitute equivalents as fall within the true spirit and scope of the present invention.

What is claimed is:

1. A method for providing an electroless plating of a platinum containing layer, comprising:

providing a $Ti^{3+}$ stabilization solution;

providing a $Pt^{4+}$ stabilization solution;

combining a flow from the $Ti^{3+}$ stabilization solution with a flow from the $Pt^{4+}$ stabilization solution and water to provide a diluted mixture of the $Ti^{3+}$ stabilization solution and the $Pt^{4+}$ stabilization solution; and exposing a substrate to the diluted mixture of the $Ti^{3+}$ stabilization solution and the $Pt^{4+}$ stabilization solution.

2. The method, as recited in claim 1, wherein exposing the substrate to the diluted mixture of the $Ti^{3+}$ stabilization solution and the $Pt^{4+}$ stabilization solution, comprises:

providing a solution temperature between 10° to 40° C., inclusive; and providing a pH of between 6 to 10, inclusive.

3. The method, as recited in claim 2, wherein exposing the wafer to the diluted mixture of the $Ti^{3+}$ stabilization solution and the $Pt^{4+}$ stabilization solution provides $Ti^{3+}$ with a concentration between 25-75 mM.

4. The method, as recited in claim 3, further comprising disposing the diluted mixture.

5. The method, as recited in claim 4, wherein the platinum containing layer is 99.9% pure platinum.

6. The method, as recited in claim 3, further comprising reactivating the diluted mixture.

7. The method, as recited in claim 3, wherein the $Ti^{3+}$ stabilization solution comprises a solution of $TiCl_3$ and HCl.

8. The method, as recited in claim 7, wherein the $Pt^{4+}$ stabilization solution comprises a solution of $H_2PtCl_6$ and ammonium hydroxide and trisodium gluconate or gluconic acid.

9. The method, as recited in claim 8, wherein the $Ti^{3+}$ stabilization solution further comprises $NH_4OH$.

10. The method, as recited in claim 9, wherein the $Pt^{4+}$ stabilization solution has a shelf life of over a month.

11. The method, as recited in claim 10, wherein the $Ti^{3+}$ stabilization solution has a shelf life of over a month.

12. The method, as recited in claim 9, wherein the diluted mixture is boron, phosphorus, hydrazine, and formaldehyde free.

13. The method, as recited in claim 1, wherein the diluted mixture is boron, phosphorus, hydrazine, and formaldehyde free.

14. A solution for electroless deposition of platinum, comprising:

$Ti^{3+}$ ions;

$Pt^{4+}$ ions, wherein a ratio of $Ti^{3+}$ to $Pt^{4+}$ ion is between 100:1 to 2:1; and $NH_4^+$ ions and citrate or gluconate or tartarate ions.

15. The solution, as recited in claim 14, wherein the solution has a pH between 6 and 10, inclusive.

16. The solution, as recited in claim 15, further comprising ions.

17. The solution, as recited in claim 16, wherein the concentration of $Ti^{3+}$ ions is 25-75 mM.

18. A method for providing an electroless plating of a platinum layer, comprising:

providing a solution for electroless deposition of platinum, comprising:

$Ti^{3+}$ ions;

$Pt^{4+}$ ions, wherein a ratio of $Ti^{3+}$ to $Pt^{4+}$ ion is between 100:1 to 2:1; and $NH_4^+$ ions, citrate and gluconate or tartarate ions; and exposing a substrate to the solution for electroless deposition of platinum.

19. The method, as recited in claim 18, wherein the providing the solution, provides the solution at a pH of between 6 to 10, inclusive, and at a temperature between 10° to 40° C., inclusive.

20. A solution for electroless deposition of platinum, comprising:

$Ti^{3+}$ ions;

$Pt^{4+}$ ions; and $NH_4^+$ ions and citrate or gluconate or tartarate ions.

21. The solution, as recited in claim 20, wherein the solution has a pH between 6 and 10, inclusive.

22. The solution, as recited in claim 21, further comprising $Cl^-$ ions.

23. The solution, as recited in claim 22, wherein the concentration of $Ti^{3+}$ ions is 25-75 mM.

24. The solution, as recited in claim 20, wherein the platinum ions are $Pt^{4+}$ ions.

25. The solution, as recited in claim 24, wherein a ratio of $Ti^{3+}$ to $Pt^{4+}$ ion is between 100:1 to 2:1.

26. The solution, as recited in claim 20, wherein the solution is boron, phosphorus, hydrazine, and formaldehyde free.

* * * * *